US009278039B2

(12) United States Patent
Bharadwaj et al.

(10) Patent No.: US 9,278,039 B2
(45) Date of Patent: Mar. 8, 2016

(54) INCUBATOR ASSEMBLY

(75) Inventors: Sanjay Bharadwaj, Bangalore (IN); Thejasvi Mysore Sathyasundara, Bangalore (IN); Roopesh Edavana, Bangalore (IN)

(73) Assignee: Koninklijke Philips N.V., Eindhoven (NL)

( * ) Notice: Subject to any disclaimer, the term of this patent is extended or adjusted under 35 U.S.C. 154(b) by 204 days.

(21) Appl. No.: 13/976,052

(22) PCT Filed: Dec. 16, 2011

(86) PCT No.: PCT/IB2011/055740

§ 371 (c)(1), (2), (4) Date: Jun. 26, 2013

(87) PCT Pub. No.: WO2012/090109

PCT Pub. Date: Jul. 5, 2012

(65) Prior Publication Data

US 2013/0274544 A1 Oct. 17, 2013

Related U.S. Application Data

(60) Provisional application No. 61/427,552, filed on Dec. 28, 2010.

(51) Int. Cl.
*A61G 11/00* (2006.01)

(52) U.S. Cl.
CPC ..... *A61G 11/006* (2013.01); *A61G 11/007* (2013.01); *A61G 11/005* (2013.01); *A61G 11/009* (2013.01)

(58) Field of Classification Search
CPC ... A61G 11/00; A61G 11/009; A61G 11/005; A61G 11/003; A61G 11/001; A61G 10/02; A61G 2210/90; A61F 7/00; A61F 7/0053; A61F 2007/0088; F24F 9/00
See application file for complete search history.

(56) References Cited

U.S. PATENT DOCUMENTS

| | | | |
|---|---|---|---|
| 4,846,783 | A | 7/1989 | Koch et al. |
| 4,936,824 | A | 6/1990 | Koch et al. |
| 5,100,375 | A | 3/1992 | Koch |
| 5,453,077 | A | 9/1995 | Donnelly et al. |
| 5,707,337 | A | 1/1998 | Franz |
| 5,730,355 | A | 3/1998 | Lessard et al. |
| 5,797,833 | A | 8/1998 | Kobayashi et al. |
| 5,840,010 | A | 11/1998 | Kobayashi et al. |
| 5,853,361 | A | 12/1998 | Kobayashi et al. |
| 5,935,055 | A | 8/1999 | Koch et al. |

(Continued)

FOREIGN PATENT DOCUMENTS

| | | | |
|---|---|---|---|
| CN | 200948212 | Y | 9/2007 |
| DE | 102006056039 | A1 | 5/2009 |
| EP | 0447958 | A1 | 9/1991 |
| GB | 2401428 | A | 11/2004 |
| WO | 9711664 | A1 | 4/1997 |

(Continued)

*Primary Examiner* — Navin Natnithithadha
*Assistant Examiner* — Kaylee Wilson

(57) ABSTRACT

An improved incubator assembly includes a number of movable walls and a circulation system having a fluid guide apparatus adjacent each movable wall. The fluid guide apparatuses generate a first jet of air in a direction generally parallel with a wall in the closed position and a second jet of air in a direction oblique to the wall in the closed position. Whenever one of the movable walls is moved from its closed position to its open position, the jet of air that had been flowing parallel with such wall continues to flow and forms an air curtain.

14 Claims, 7 Drawing Sheets

(56) References Cited

U.S. PATENT DOCUMENTS

| | | | | |
|---|---|---|---|---|
| 6,428,465 | B1 | 8/2002 | Belsinger, Jr. | |
| 6,880,188 | B1 * | 4/2005 | Schmidt et al. | 5/603 |
| 2008/0125619 | A1 | 5/2008 | Otte et al. | |
| 2008/0207987 | A1 | 8/2008 | Kuo | |

FOREIGN PATENT DOCUMENTS

| | | | |
|---|---|---|---|
| WO | 9921526 | | 5/1999 |
| WO | 2005087170 | A1 | 9/2005 |
| WO | 2005102243 | A1 | 11/2005 |
| WO | 2010071705 | A1 | 6/2010 |

* cited by examiner

INCUBATOR ASSEMBLY

The disclosed and claimed concept relates generally to infant incubators and, more particularly, to an infant incubator assembly having an improved air distribution system.

Incubators such as those used by infants in hospitals or other medical settings are generally known. Incubators typically include a canopy, the interior of which is maintained at desirable temperature and humidity levels in order to promote infant growth. As is generally understood, the ability for a newborn infant to maintain and regulate its body temperature is directly relevant to survival and growth. Infants who are born prematurely or at a low birth weight or who require medical procedures that require them to be unclothed struggle to maintain body temperature. Calories that are expended in maintaining body temperature cannot otherwise be used for the infant's weight gain, which is undesirable. While infant incubators have typically been generally effective for their intended purposes, they have not been without limitation.

The design of an infant incubator typically involves mutually balancing a number of tradeoffs. For instance, some of the goals desired to be achieved with any infant incubator include assuring a uniform temperature and humidity environment within the interior of the canopy, keeping air velocities very low in the vicinity of the infant, minimizing local recirculation zones, i.e., "dead zones", and maintaining the integrity of the heated and humidified environment in the vicinity of the infant when ports or walls are opened. The aforementioned considerations are not intended to constitute an exhaustive list and rather are intended to illustrate some of the difficulties and the necessary balancing of competing considerations in the design of an infant incubator.

It thus would be desirable to provide an improved incubator assembly that provides improved performance according to one or more of the aforementioned considerations.

Accordingly, an improved incubator assembly includes a number of movable walls and a circulation system having a fluid guide apparatus adjacent each movable wall. The fluid guide apparatuses generate a first jet of air in a direction generally parallel with a wall in the closed position and a second jet of air in a direction oblique to the wall in the closed position. The fluid guide apparatus are disposed at the periphery of a patient support platform upon which the patient is disposed, and a roof of the canopy has a number of elongated openings formed therein into which the air flows for return to a circulation system. Whenever one of the movable walls is moved from its closed position to its open position, the jet of air that had been flowing parallel with such wall continues to flow and thus forms an air curtain between the interior of the canopy and the external environment. In such a situation, the oblique jets continue to direct air into the interior to maintain the desired temperature and humidity conditions on the interior side of the air curtain.

According, an aspect of the disclosed and claimed concept is to provide an improved incubator assembly having improved air flow.

Another aspect of the disclosed and claimed concept is to provide an improved incubator assembly having jets that blow air parallel with an adjacent movable wall in a closed position and that form an air curtain when the movable wall is moved to an OPEN position.

Another aspect of the disclosed and claimed concept is to provide an improved incubator assembly having jets that form air curtains when movable walls are opened and that include further jets that blow air generally into the interior of the canopy.

Another aspect of the disclosed and claimed concept is to provide an improved incubator assembly having a fixed wall with a channel formed therein that serves as a return flow channel for air that has passed through the interior of the canopy.

These and other aspects of the disclosed and claimed concept are provided by an improved incubator assembly, the general nature of which can be stated as including a patient support platform, a canopy, and a circulation system. The canopy is situated to surround at least a portion of the patient support platform and comprises a wall apparatus and a roof. The wall apparatus extends between the patient support platform and the roof, and the canopy has an interior between the patient support platform and the roof. The wall apparatus comprises a plurality of walls, at least some of which are each movable between a closed position extending between the roof and a region peripheral to the patient support platform and an open position displaced from at least one of the roof and the region peripheral to the patient support platform. The circulation system is structured to circulate fluid within the interior and comprises a fluid pump and further comprising a number of fluid guide apparatuses each extending adjacent at least a portion of the patient support platform. At least some of the fluid guide apparatuses each comprise a first opening structured to direct a first jet of fluid in a direction generally parallel with a wall in the closed position and a second opening structured to direct a second jet of fluid in a direction oblique to the wall in the closed position.

A further understanding of the disclosed and claimed concept can be gained from the following Detailed Description of Exemplary Embodiments when read in conjunction with the accompanying drawings in which:

Similar numerals refer to similar parts throughout the specification.

Figure 1B:
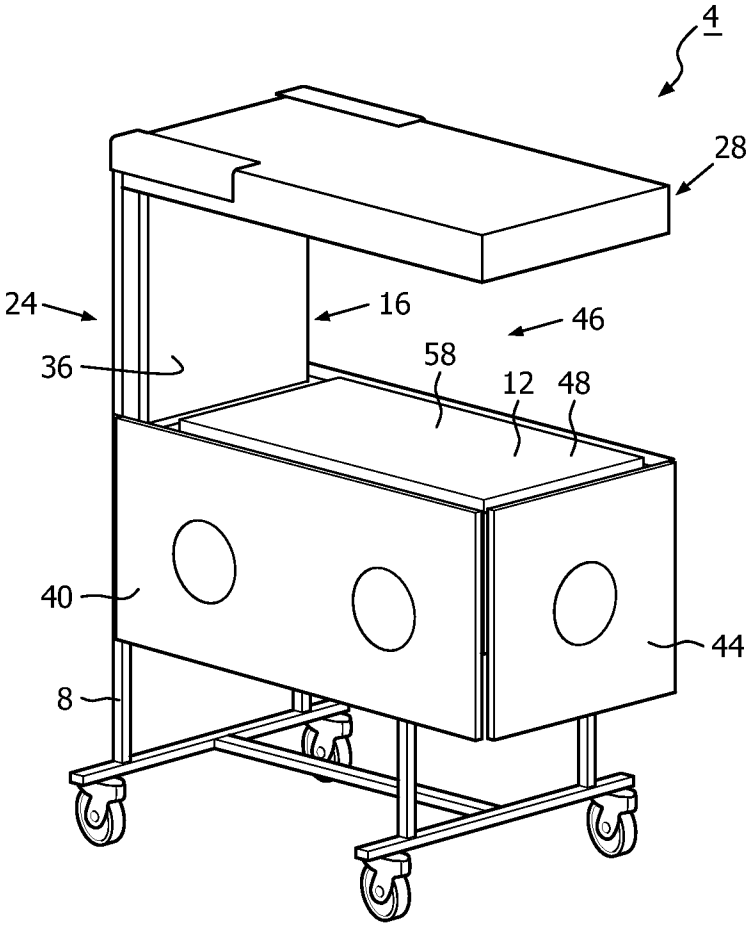
FIG. 1B is another view of the incubator assembly of FIG. 1A wherein three walls are in an OPEN position.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

Figure 1A:
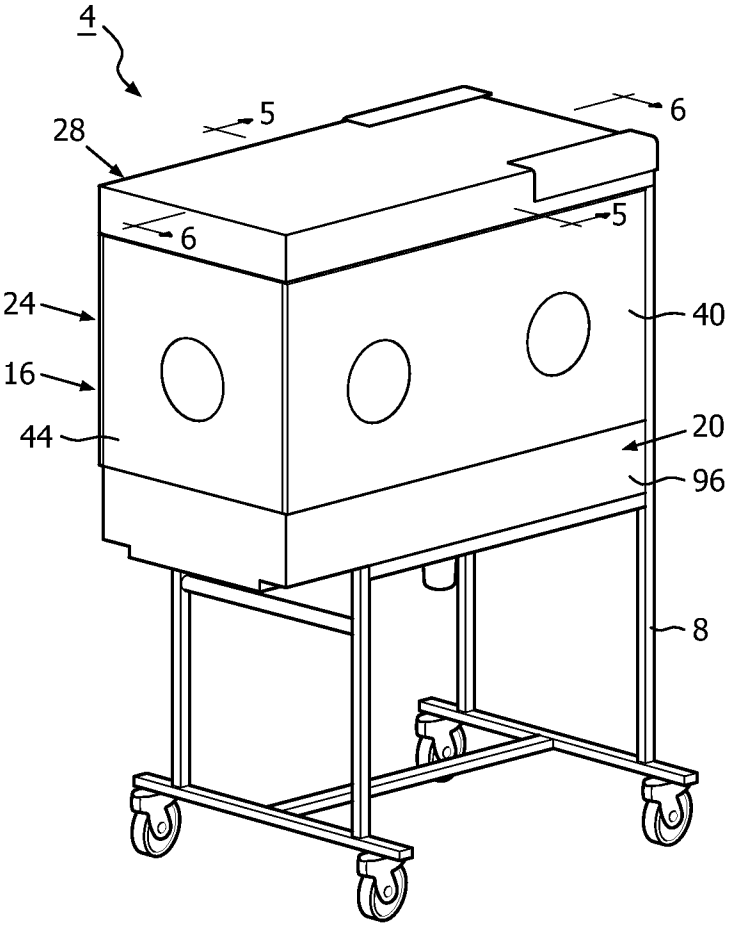
FIG. 1A is a view of an improved incubator assembly in accordance with an embodiment of the disclosed and claimed concept having its walls in a CLOSED position.

An improved incubator assembly in accordance with an embodiment of the disclosed and claimed concept is depicted generally in FIGS. 1A and 1B. Incubator assembly 4 is depicted as being situated on a base 8 having rollable casters, but it is understood that incubator assembly 4 could be otherwise situated without departing from the present concept.

Incubator assembly 4 includes a patient support platform 12, which can be seen in FIG. 1B, a canopy 16, and a circulation system 20. Canopy 16 surrounds patient support platform 12 at its sides and top. Circulation system 20 is configured to circulate fluid within canopy 16, and as can be understood from FIGS. 1A and 1B, patient support platform 12 and canopy 16 are disposed atop circulation system 20. In most usage, the fluid that is circulated by circulation system 20 is air, but it is understood that other gases or mixtures of gases can be circulated within canopy 16 by circulation system 20 without departing from the present concept.

Canopy 16 includes a wall apparatus 24 and a roof 28. Wall apparatus 24 includes a plurality of walls that include a fixed wall 36, a pair of movable side walls 40, and a movable end wall 44. Side walls 40 and end wall 44 are movable between a CLOSED position, as is depicted generally in FIG. 1A, and an OPEN position, as is depicted generally in FIG. 1B. Fixed wall 36 supports roof 28 above patient support platform 12 and serves other purposes that will be mentioned in greater detail elsewhere herein. Canopy 16 can be said to include an interior 46, which is the region between patient support platform 12 and roof 28 and which can be said to be bounded by fixed wall 36 and which can further be said to be bounded by side walls 40 and end wall 44 when in their CLOSED position.

Figure 2:
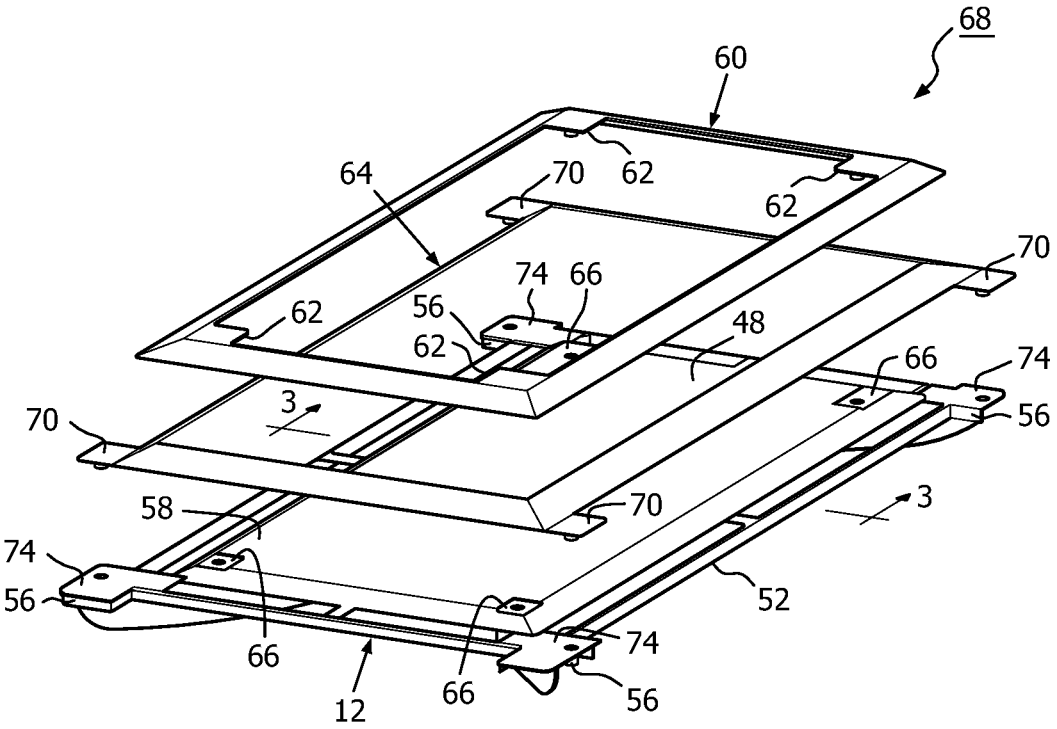
FIG. 2 is a exploded view of a patient support assembly of the incubator assembly of FIG. 1.

As can be understood from FIG. 2, patient support platform 12 includes a substantially planar central plate 48 and an inner guide vane apparatus 52 that extends about the periphery of central plate 48 which, in the exemplary embodiment depicted herein, is rectangular and thus includes four sides. Patient support platform 12 further includes four bracing elements 56, one being disposed at each corner. A patient such as an infant typically lies on a substantially planer support surface 58 of central plate 48, most typically on a mattress or other type of cushioning device that is sized to fit on central plate 48 without extending beyond inner guide vane apparatus 52. It is noted that the words "infant" and "patient" are used more or less interchangeably herein, but such use is not intended to be limiting. Support surface 58 faces toward roof 28 and toward interior 46.

As mentioned above, circulation system 20 is structured to circulate air or another fluid throughout incubator assembly 4. While certain elements of incubator assembly 4 are mentioned herein as being a part of circulation system 20, it is understood that numerous other structures that are not expressly indicated herein as being a part of circulation system 20 actually facilitate or otherwise assist with such circulation. It is thus noted that the indication herein of an element either being a part of circulation system 20 or not being a part of circulation system 20 is not intended to be limiting.

Figure 3:
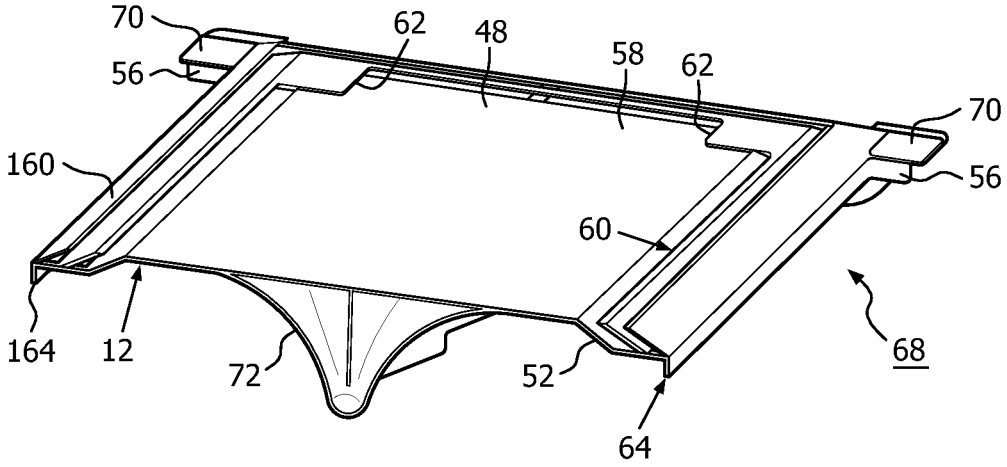
FIG. 3 is a sectional view of the patient support assembly of FIG. 2 in a non-exploded condition as taken along line 3-3 of FIG. 2.

As can be understood from FIGS. 2 and 3, circulation system 20 includes an intermediate guide vane apparatus 60 and an outer guide vane apparatus 64 that are disposed on patient support platform 12. Intermediate guide vane apparatus includes a plurality of bracing elements 62 that are received in a corresponding plurality of receptacles 66 of central plate 48. Once intermediate guide vane apparatus 60 has been assembled to patient support platform 12, outer guide vane apparatus 64 is assembled to patient support platform 12 by receiving four bracing elements 70 of outer guide vane apparatus 64 in correspondingly formed receptacles 74 of bracing elements 56. Patient support platform 12, intermediate guide vane apparatus 60, and outer guide vane apparatus 64 together form a patient support assembly 68, which is depicted in FIG. 2 in an exploded fashion and which is depicted in a sectional fashion in FIG. 3. As can be further understood from FIG. 3, circulation system 20 includes a diverter 20 that is disposed at a surface of central plate 48 opposite support surface 58 and potentially can be co-formed with patient support platform 12, although the separate formation of diverter 72 would not be outside the scope of the present concept.

Figure 4:
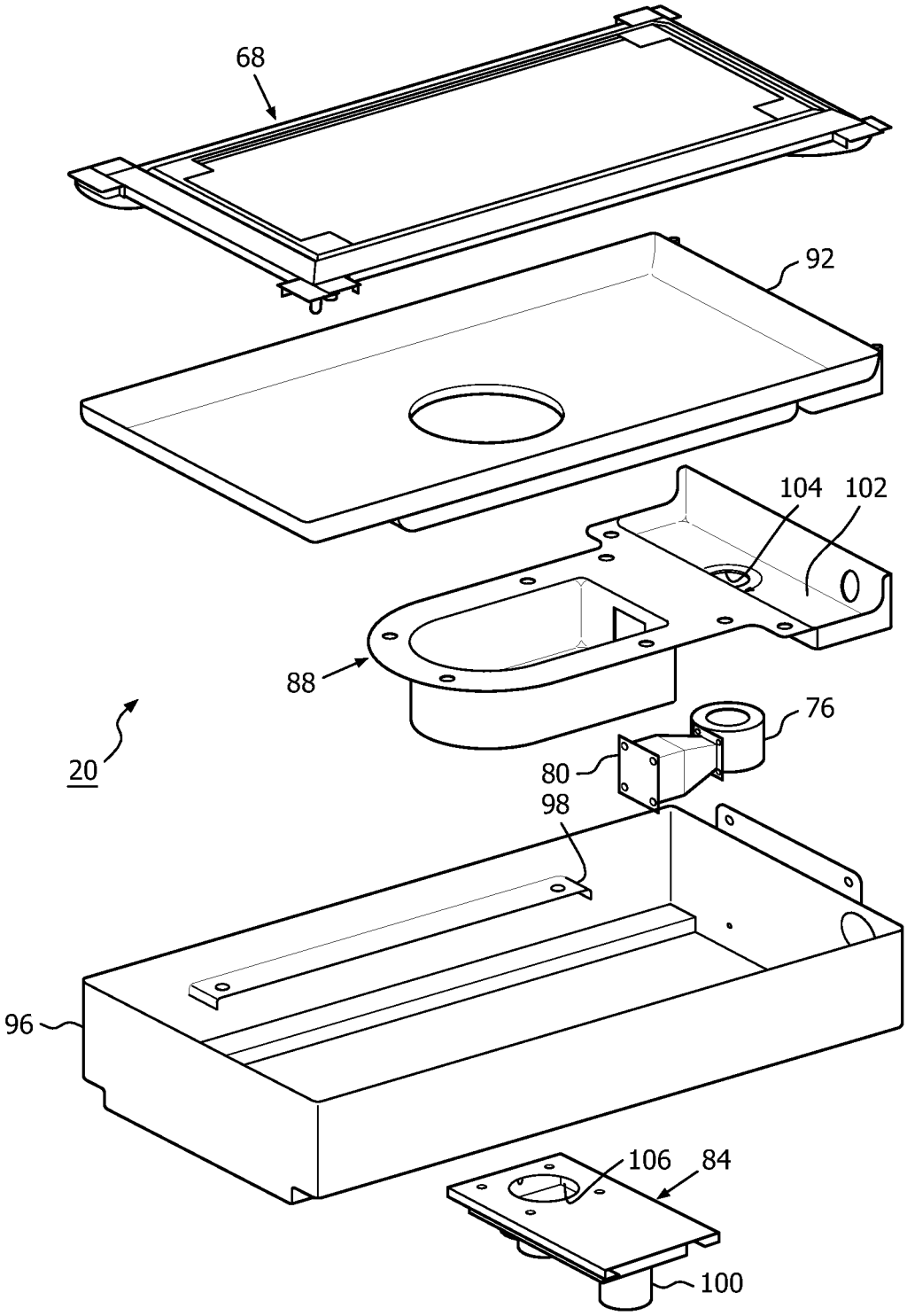
FIG. 4 is an exploded view of a circulation system of the incubator assembly of FIG. 1A.

As can be understood from FIG. 4, circulation system 20 can be said to include patient support assembly 68, a fan 76, a heater 80, and a humidifier assembly 84. Fan 76 can be said to function as a fluid pump to circulate air past heater 20 and humidifier assembly 84 and then into interior 46. More particularly, air exiting heater 80 passes through a mixing chamber 88 of circulation system 20 where it is humidified by humidifier assembly 84 and thereafter flows through the space between an inlet tub 90 of circulation system 20 and diverter 72 along with other portions of the surface of patient support platform 12 where diverter 72 is disposed.

Circulation system 20 further includes a frame 96 having a pair of rails 98 upon which inlet tub 92 is disposed. Bracing elements 56 of patient support platform 12 are situated upon the four corners of frame 96. For the sake of completeness, it is noted that humidifier assembly 84 includes a water reservoir 100 and an ultrasonic humidifier 106, although it is understood that other types of humidifying devices can be employed without departing from the present concept.

Figure 7:
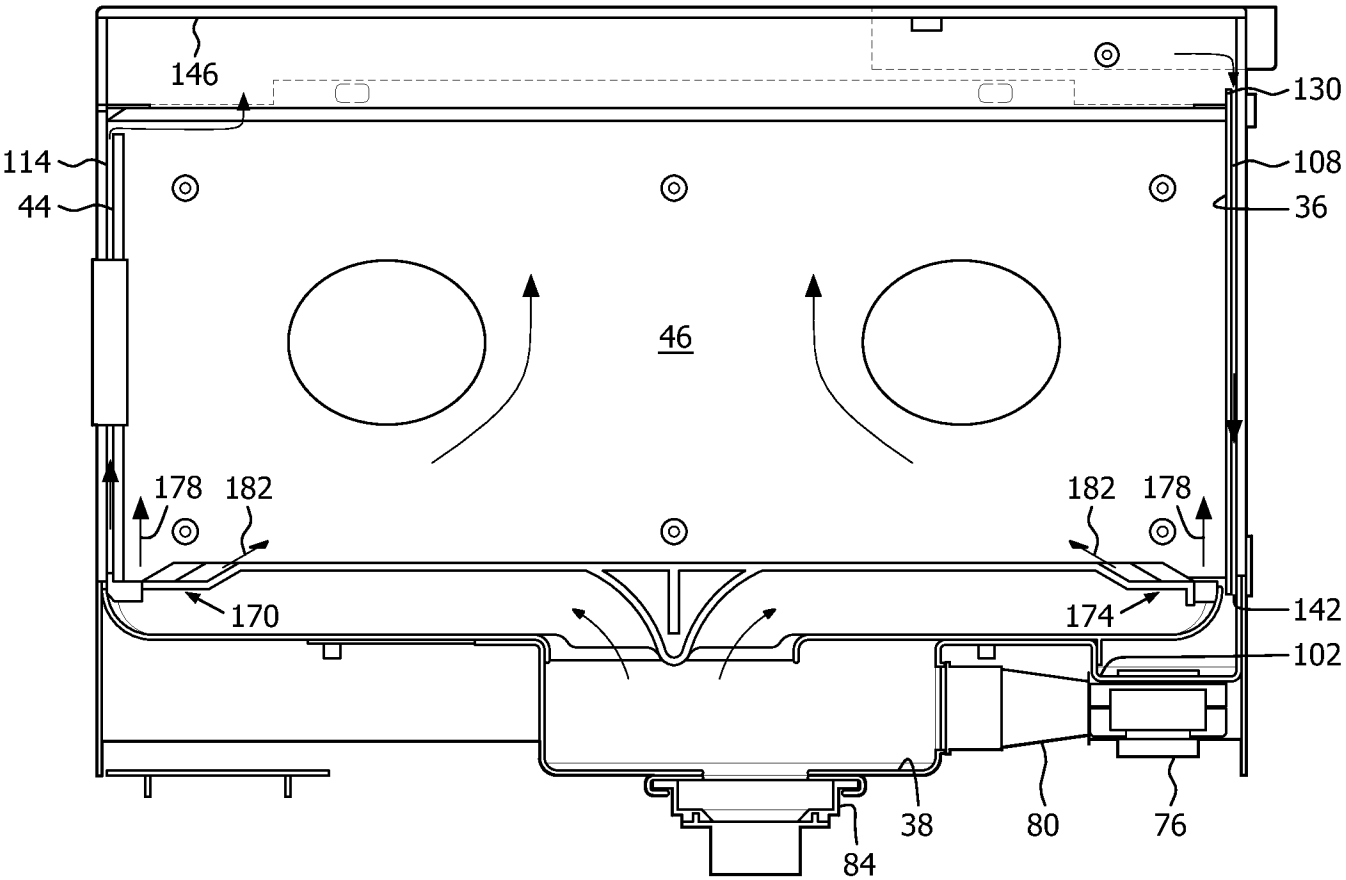
FIG. 7 is another sectional view as taken along line 6-6 of FIG. 1A.

As can further be understood from FIG. 4, mixing chamber 88 additionally includes a plenum 102 having a hole 104 that is in fluid communication with the central region of fan 76. As can be understood from FIG. 7, plenum 102 is situated beneath and in fluid communication with a channel 108 which is formed in fixed wall 36 and which returns to circulation system 20 air that has already passed through interior 46.

Figure 5:
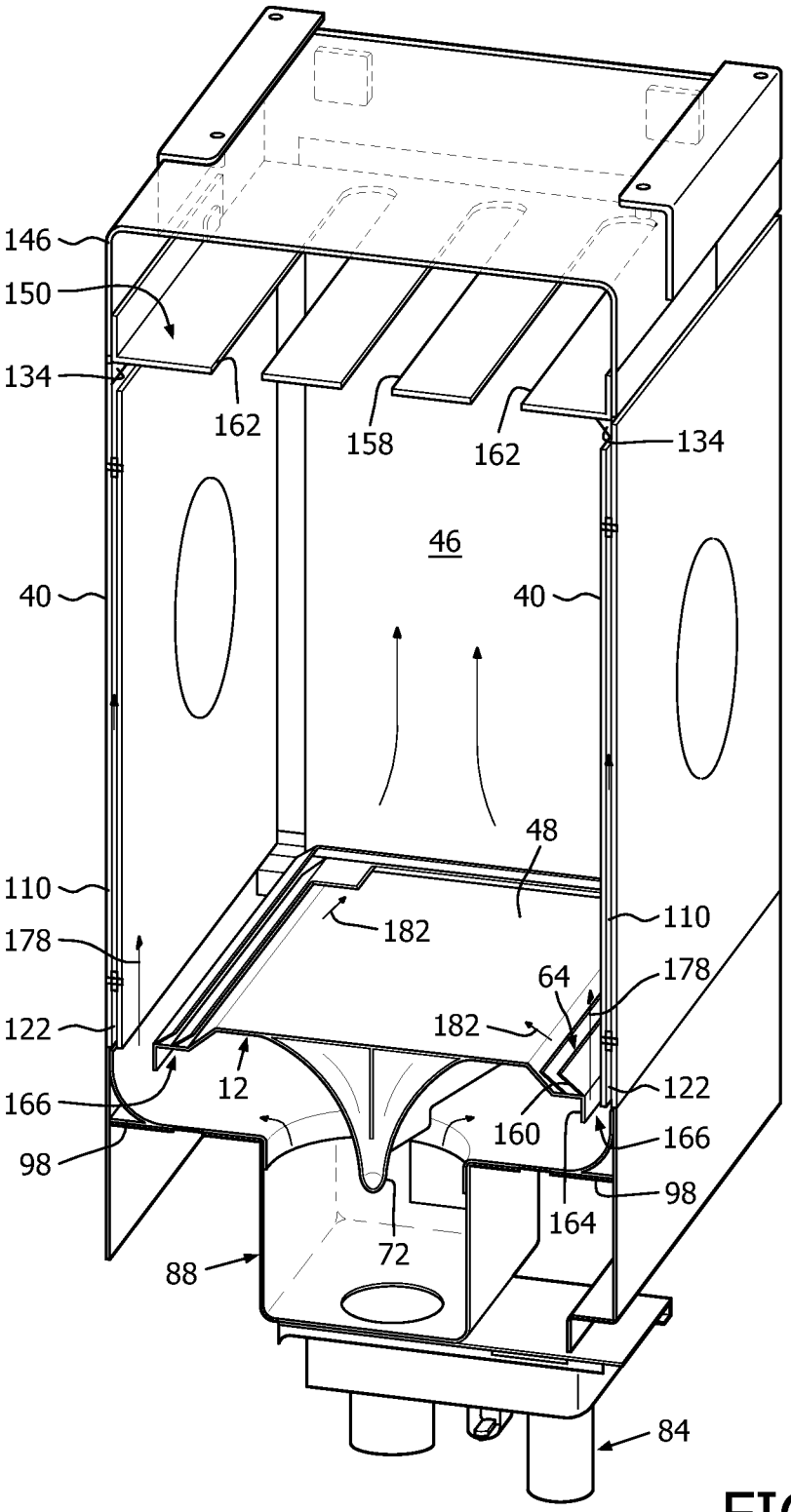
FIG. 5 is a sectional view as taken along line 5-5 of FIG. 1A.
Figure 6:
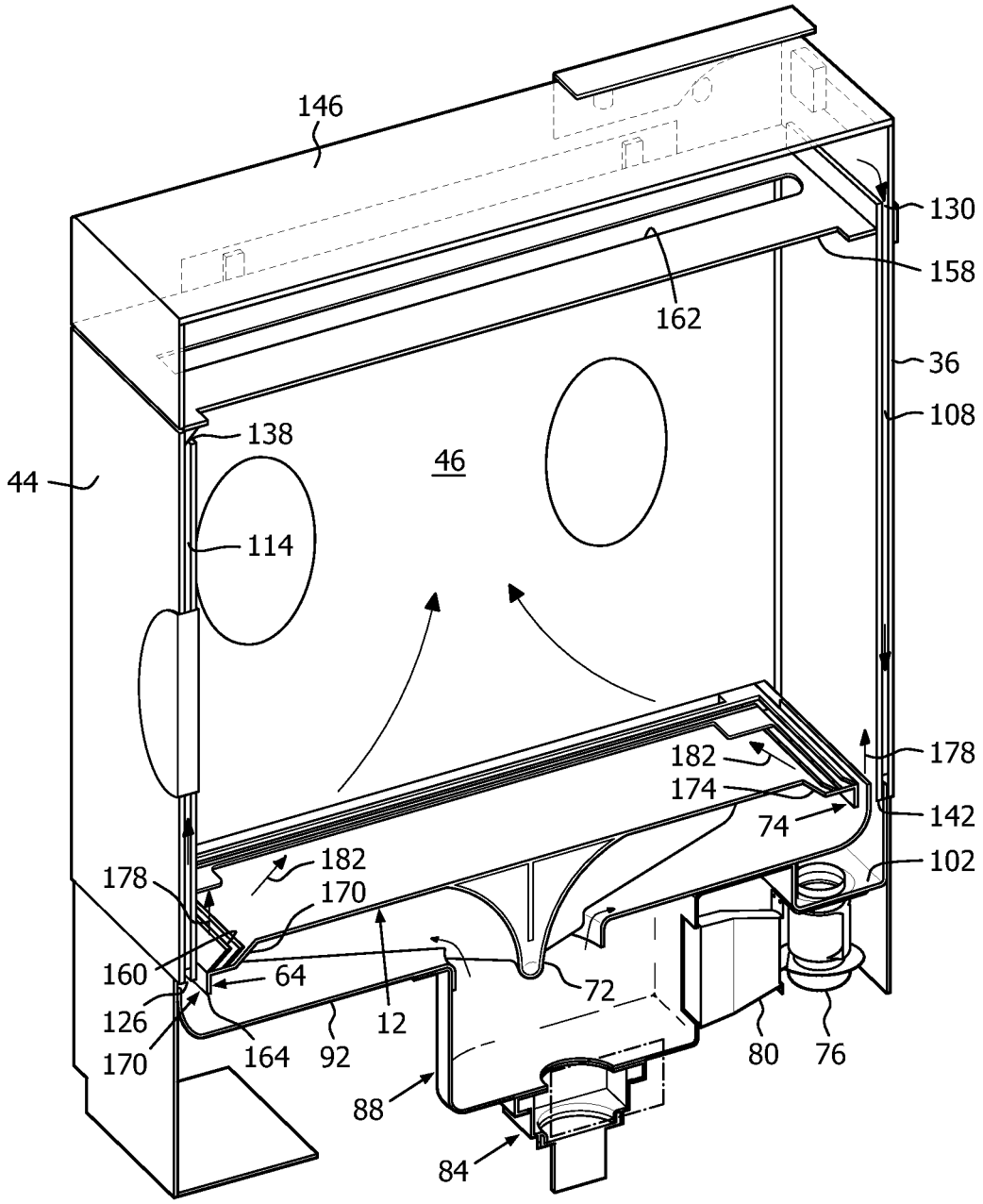
FIG. 6 is a sectional view as taken along line 6-6 of FIG. 1A.

With reference to FIGS. 5 and 6, it can be seen that side walls 40 each have a channel 110 formed therein, and end wall 44 likewise has a channel 114 formed therein. Channels 110 each have an inlet 122 adjacent inlet adjacent tub 92 and an outlet 134 opposite thereto adjacent roof 28. Channel 114 likewise includes an inlet 126 adjacent inlet tub 92 and an outlet 138 adjacent roof 28. When side walls 40 and end wall 44 are in their CLOSED positions, as is indicated generally in FIGS. 5-7, air that is pushed by fan 76 exits openings at the peripheral regions of inlet tub 92 and can flow into inlets 122 and 126, through channels 110 and 114, and out of outlets 134 and 138. While channels 110 and 114 are optional, it is understood that they are advantageous since they tend to heat side walls 40 and end wall 44, which likewise advantageously reduces radiant heat loss by the infant disposed within interior 46.

Channel 108 of fixed wall 36 has an inlet 130 adjacent roof 28 and has an outlet 142 adjacent plenum 102. In this regard, it is reiterated that channel 108 carries air from interior 46 in a return path to plenum 102 and thus to circulation system 20. More particularly, roof 28 includes a manifold 146 and a distribution plate 150 having a plurality of elongated openings formed therein. Manifold 146 acts as a cover disposed atop distribution plate 150, and inlet 130 is disposed adjacent and in fluid communication with manifold 146. The elongated openings formed in distribution plate 150 include an elongated central opening 158 and a pair of elongated lateral openings 162 disposed on alternate sides of central opening 158 and situated roughly midway between central opening 158 and side walls 40 in their CLOSED position. Central opening 158 and lateral openings 162 are oriented parallel with one another and with side walls 40.

As can be seen from FIG. 5, outer vane apparatus 64 includes a set of upper vanes 160 and a set of lower vanes 164. Air flowing from fan 76 and out of inlet tub 92 flows on both sides of lower vanes 164 and out of openings of what can be called a fluid guide apparatus. More particularly, a pair elongated fluid guide apparatuses 166 extend adjacent and parallel side walls 40, a fluid guide apparatus 170 extends adjacent and parallel end wall 44, and a fluid guide apparatus 174 extends adjacent and parallel fixed wall 36. Fluid guide apparatuses 166, 170, and 174 are in fluid communication with canopy 16 and direct the air or other fluid from circulation system 20 into interior 46. More particularly, air flowing through the opening in the space between lower vanes 164 and inlet tub 92 form a number of vertical jets 178 that flow into inlets 122 and 126 and that additionally flow parallel with fixed wall 36, side walls 40, and end wall 44 alongside the surfaces of such walls that are adjacent interior 46. Air from vertical jets 178 that are formed by fluid guide apparatuses 166 disposed adjacent side walls 40 enters inlets 122, flows through channels 110, and exits outlets 134, after which such air flows into lateral openings 162 for return to circulation system 20. Similarly, the portions of vertical jets 178 that do not enter inlets 122 and that instead flow along side walls 40 in their CLOSED position toward roof 28 flow into lateral openings 162 for return to circulation system 20.

Air flowing in vertical jets 178 that emanate from fluid guide apparatus 170 and that flows through channel 114 exits through outlet 138 and passes into central opening 158 and lateral openings 162 for return to circulation system 20, as does the air from such vertical jets 178 that flows past the surface of end wall 44 that is disposed adjacent interior 46. Air from vertical jets 178 that emanate from fluid guide apparatus 174 flows past the surface of fixed wall 36 that is disposed adjacent interior 46 and enters central opening 158 and both lateral openings 162 for return to circulation system 20.

Figure 8:
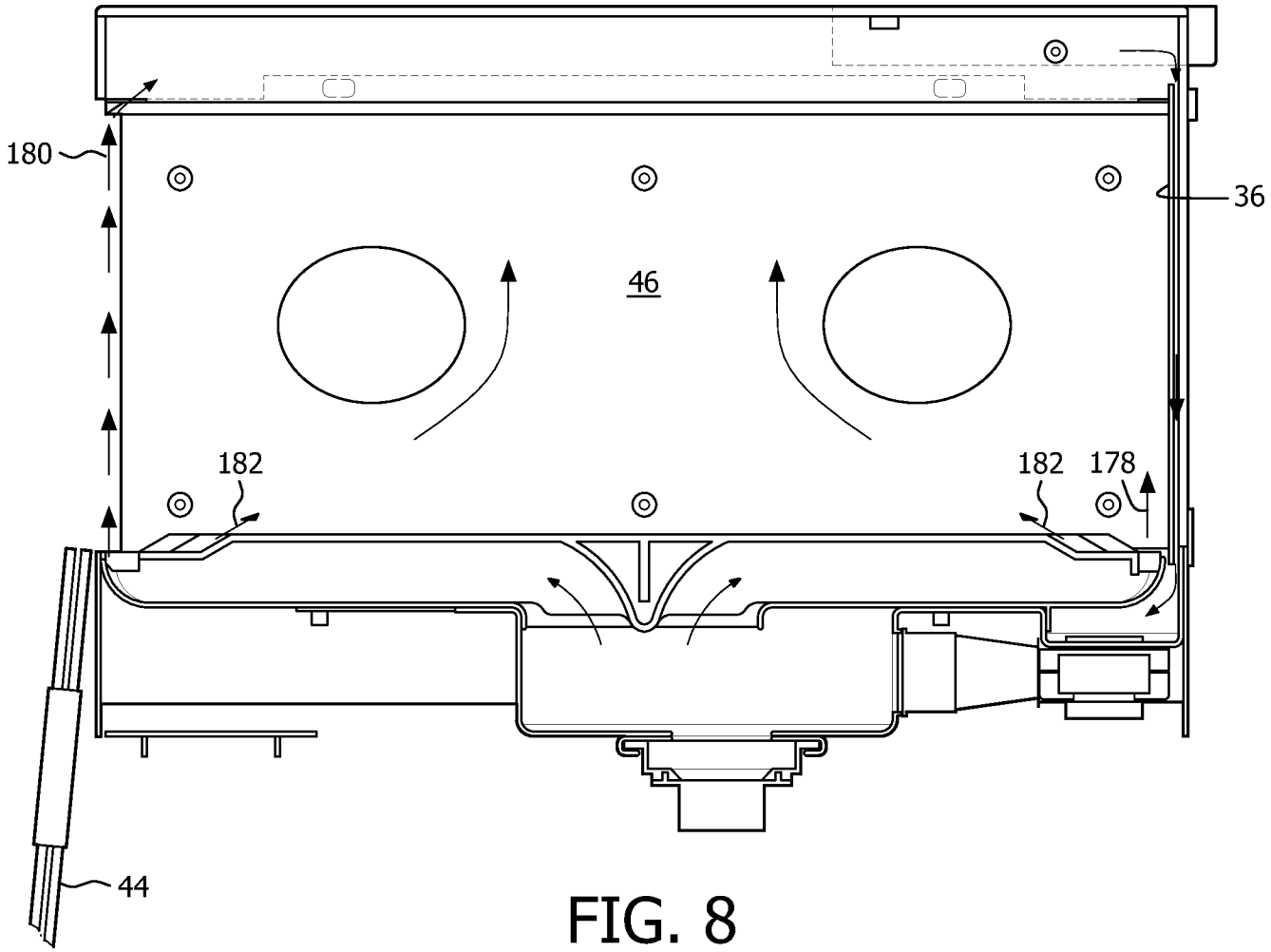
FIG. 8 is a view similar to FIG. 7 except depicting a wall in an OPEN position.

As can be understood from FIG. 8, when a movable wall is moved from its CLOSED position to its OPEN position, vertical jet 178 from whichever fluid guide apparatus is disposed adjacent the wall that was opened continues to flow upward toward roof 28 but advantageously forms an air curtain. Such an exemplary air curtain is indicated at the numeral 180 which formed as a result of end wall 44 being moved to its OPEN position. Similar air curtains are formed by vertical jets 178 from fluid guide apparatuses 166 when side walls 40 are moved to their OPEN positions, although these are not expressly depicted herein for reasons of clarity and simplicity. Advantageously, since vertical jets 178 already flow past side walls 40 and end wall 44 when in their CLOSED positions, and likewise flow through channels 110 and 114 if provided in side walls 40 and end wall 44, no change in the speed of fan 96 is needed to form the air curtains such as air curtain 180, and no change in air velocity or air capacity is likewise needed. That is, vertical jets 178 already flow vertically upward from the perspective of FIGS. 5-7 when side walls 40 and end wall 44 are in their CLOSED positions, and when any one or more of such walls are moved to the OPEN position, the air curtains such as air curtain 180 spontaneously form from vertical jets 178. Thus, no additional fluid flow is needed when any one or more of side walls 40 and end wall 44 are opened, and likewise no sensors are required for detecting such a condition.

Further advantageously, openings in fluid guide apparatuses 166, 170, and 174 each form oblique jets 182 of air that are oriented oblique to the adjacent wall in the CLOSED position. As employed herein, the expression "oblique" and variations thereof shall refer broadly to an orientation that is neither parallel nor perpendicular to a reference. In the exemplary embodiment depicted herein, oblique jets 182 are oriented to flow out of the openings in fluid guide apparatuses 166, 170, and 174 at an angle in the range of about 15° to 45° with respect to support surface 58 of patient support platform 12. In the exemplary embodiment depicted herein, oblique jets 182 are oriented at an angle of about 30° from support surface 58 and are directed generally toward central plate 48 and interior 46. That is, oblique jets 182 are oriented at an oblique angle with respect to support surface 58 but blow air in a direction generally away from fixed wall 36, side walls 40, and end wall 44, and generally toward interior 46 and central plate 48.

Advantageously, oblique jets 182 thus are directed generally toward the patient disposed on patient support platform 12 and then flow upward through interior 46, through central opening 158, and into manifold 146 for return to circulation system 20 through channel 108. Oblique jets 182 thus are configured to have a sufficiently low air velocity in the vicinity of the patient to avoid causing irritation to the patient. It is noted that while oblique jets 182 are characterized as flowing from interior 46 into central opening 158, it is understood that this refers merely to the general flow of air in oblique jets 182, and that at least a certain portion of the air of oblique jets 182 will likewise flow through lateral openings 162. In a similar fashion, while the air from fluid guide apparatuses 166 has been described herein as flowing through lateral openings 162 and into manifold 146 for return to circulation system 20, it is understood that a certain portion of the air from such vertical jets 178 is expected to flow through central opening 158.

As can be understood from the foregoing, vertical jets 178 and oblique jets 182 advantageously cooperate to create an environment within interior 46 having temperature and humidity that are controlled regardless of one or more of side walls 40 and end wall 44 being in their OPEN or CLOSED positions, and no control system is required to detect or compensate for such walls being in either of such positions. This is because vertical jets 178, which flow at all times whether side walls 40 and end wall 44 are in the OPEN or CLOSED positions, automatically form air curtains such as air curtain 180 when the adjacent side wall 40 or end wall 44 is moved to its OPEN position. Air curtains such as air curtain 180 isolate interior 46 from the exterior of incubator assembly 4, which helps to maintain the desired temperature and humidity within interior 46. Further advantageously, oblique jets 182 separately direct air into interior 46 regardless of the positions of side wall 40 and end wall 44 and serve to circulate air within interior 46, whether interior 46 is bounded by one or more side walls 40 and end wall 44 or by air curtains that have correspondingly formed when any one or more of side walls 40 and end wall 44 have been moved to their OPEN positions. Such circulation of air within interior 46 by oblique jets 182 thus avoids the formation of significant local recirculation zones, which is advantageous. They are also advantageously configured for very low air velocities near the patient on patient support platform 12 while maintaining uniformity of temperature, humidity, and air flow in the vicinity of the patient. Channels 110 and 114, if provided, help to keep side walls 40 and end wall 44 at a warmed temperature, thus helping to reduce radiative heat loss by the patient.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An incubator assembly comprising:

a patient support platform;

a canopy situated to surround at least a portion of the patient support platform, the canopy comprising a wall apparatus and a roof, the wall apparatus extending between the patient support platform and the roof, the canopy having an interior between the patient support platform and the roof;

the wall apparatus comprising a plurality of walls, at least one wall within the plurality of walls being movable between a closed position extending between the roof and a region peripheral to the patient support platform and an open position wherein the at least one wall is displaced from at least one of the roof and the region peripheral to the patient support platform, the at least one wall including a channel formed internally within the wall and configured to conduct fluid, wherein the channel has an outlet adjacent the roof; and a circulation system structured to circulate fluid within the interior of the canopy and through the interior channel of the wall, the circulation system comprising a fluid pump and a number of fluid guide apparatuses extending adjacent to at least a portion of the patient support platform, at least some of the fluid guide apparatuses comprising:

a first opening structured to direct a first jet of fluid toward the roof both:

(a) through the interior channel in the at least one wall, and (b) within the canopy along an interior surface of the at least one wall in a direction generally parallel with the at least one wall in the closed position, and a second opening structured to direct a second jet of fluid in a direction oblique to the at least one wall in the closed position, wherein the roof forms therein a number of elongated openings that comprise a first elongated opening extending generally centrally along the roof and a lateral elongated opening extending substantially parallel with the first elongated opening and being situated between the first elongated opening and the at least first wall, the number of elongated openings being structured to receive fluid therethrough for transmission in a direction toward the fluid pump.

2. The incubator assembly of claim 1 wherein a fixed wall of the wall apparatus has a channel formed internally therein that is structured to carry fluid in a return path from within the canopy toward the fluid pump.

3. The incubator assembly of claim 1 wherein the circulation system comprises a pair of the fluid guide apparatuses that are elongated and extend along opposite sides of the patient support platform, and wherein the roof has formed therein a number of elongated openings that extend generally parallel with the pair of fluid guide apparatuses.

4. The incubator assembly of claim 3 wherein the number of elongated openings comprise a first elongated opening extending generally centrally along the roof and a pair of lateral elongated openings extending substantially parallel with and spaced from the first elongated opening.

5. The incubator assembly of claim 4 wherein the pair of lateral elongated openings are situated on opposite sides of the first elongated opening and disposed generally midway between the first elongated opening and an adjacently situated wall in the closed position.

6. The incubator assembly of claim 1 wherein the channel formed in the at least one wall has an inlet which, with the at least one wall in the closed position, is in fluid communication with the first opening, the first opening being structured to direct fluid into the inlet and through the channel in addition to directing the first jet in the direction generally parallel with the at least first wall.

7. The incubator assembly of claim 1 wherein the plurality of walls comprise a fixed wall and further comprise at least a pair of walls that are movable between the closed and open positions, the at least pair of walls including the at least one wall, and wherein the number of fluid guide apparatuses comprise a fluid guide apparatus disposed adjacent the fixed wall and fluid guide apparatuses disposed adjacent to both of the at least pair of walls.

8. The incubator assembly of claim 7 wherein the patient support platform comprises four sides, and wherein the at least pair of walls comprises three walls, the fluid guide apparatuses being disposed between a side of the patient support platform and a wall of the plurality of walls, the second opening in an individual fluid guide apparatus being structured to direct the second jet of fluid in a direction generally toward the patient support platform.

9. The incubator assembly of claim 8 wherein the patient support platform comprises a substantially planar support surface, and wherein the second opening in an individual fluid guide apparatus is structured to direct the second jet of fluid in a direction generally toward the patient support platform at an angle in the range of about 15° to about 45° with respect to the support surface.

10. The incubator assembly of claim 1 wherein the fluid pump operates at a given speed when all of the walls of the plurality of walls are in the closed position, the fluid pump operating at the same given speed when one or more of the walls are in the open position.

11. The incubator assembly of claim 1 wherein, with the at least one wall in the open position, the first jet of fluid forms an air curtain between the roof and the patient support platform.

12. An incubator assembly comprising:

a patient support platform;

a canopy situated to surround at least a portion of the patient support platform, the canopy comprising a wall apparatus and a roof, the wall apparatus extending between the patient support platform and the roof, the canopy having an interior between the patient support platform and the roof;

the wall apparatus comprising a plurality of walls, at least one wall within the plurality of walls being movable between a closed position extending between the roof and a region peripheral to the patient support platform and an open position wherein the at least one wall is displaced from at least one of the roof and the region peripheral to the patient support platform, the at least one wall including a channel formed internally within the wall and configured to conduct fluid; and a circulation system structured to circulate fluid within the interior of the canopy and through the interior channel of the wall, the circulation system comprising a fluid pump and a number of fluid guide apparatuses extending adjacent to at least a portion of the patient support platform, at least some of the fluid guide apparatuses comprising:

a first opening structured to direct a first jet of fluid toward the roof both:

(a) through the interior channel in the at least one wall, and (b) within the canopy along an interior surface of the at least one wall in a direction generally parallel with the at least one wall in the closed position, and a second opening structured to direct a second jet of fluid in a direction oblique to the at least one wall in the closed position, wherein the roof comprises a manifold, and wherein the roof has formed therein a number of elongated openings in fluid communication with the manifold, the number of elongated openings comprising a first elongated opening extending generally centrally along the roof and a pair of lateral elongated openings extending substantially parallel with and spaced from the first elongated opening, and wherein the fixed wall has a channel formed internally therein that is in fluid communication with the manifold and is structured to carry fluid in a return path from within the canopy toward the fluid pump.

13. An incubator assembly comprising:

a patient support platform;

a canopy situated to surround at least a portion of the patient support platform, the canopy comprising a wall apparatus and a roof, the wall apparatus extending between the patient support platform and the roof, the canopy having an interior between the patient support platform and the roof;

the wall apparatus comprising a plurality of walls, at least one wall within the plurality of walls being movable between a closed position extending between the roof and a region peripheral to the patient support platform and an open position wherein the at least one wall is displaced from at least one of the roof and the region peripheral to the patient support platform, the at least one wall including a channel formed internally within the wall and configured to conduct fluid; and a circulation system structured to circulate fluid within the interior of the canopy and through the interior channel of the wall, the circulation system comprising a fluid pump and a number of fluid guide apparatuses extending adjacent to at least a portion of the patient support platform, at least some of the fluid guide apparatuses comprising:

a first opening structured to direct a first jet of fluid toward the roof both:

(a) through the interior channel in the at least one wall, and (b) within the canopy along an interior surface of the at least one wall in a direction generally parallel with the at least one wall in the closed position, and a second opening structured to direct a second jet of fluid in a direction oblique to the at least one wall in the closed position, wherein the plurality of walls comprise three walls, individual ones of the three walls have a channel formed internally therein that is structured to carry fluid therethrough, the channel having an inlet which, with the individual ones of the walls in the closed position, is in fluid communication with the first opening of the fluid guide apparatus disposed adjacent to the wall, the first opening being structured to direct fluid into the inlet and through the channel in addition to directing the first jet in the direction generally parallel with the wall, wherein the roof comprises a manifold, the roof having formed therein a number of elongated openings in fluid communication with the manifold, the number of elongated openings comprising a first elongated opening extending generally centrally along the roof and a pair of lateral elongated openings extending substantially parallel with and spaced from the first elongated opening, and wherein the fixed wall has a channel formed internally therein that is in fluid communication with the manifold and is structured to carry fluid in a return path from within the canopy toward the fluid pump.

14. The incubator assembly of claim 13 wherein the individual channels in the walls have an outlet adjacent to the roof, the pair of lateral elongated openings extending substantially parallel with and being spaced from the outlets of a pair of parallel walls of the three walls.

* * * * *